US007051812B2

(12) United States Patent
McKee et al.

(10) Patent No.: US 7,051,812 B2
(45) Date of Patent: May 30, 2006

(54) FRACTURING TOOL HAVING TUBING ISOLATION SYSTEM AND METHOD

(75) Inventors: L. Michael McKee, Friendswood, TX (US); David M. Eslinger, Broken Arrow, OK (US); Keith A. Ryder, Richmond, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 319 days.

(21) Appl. No.: 10/781,202

(22) Filed: Feb. 18, 2004

(65) Prior Publication Data

US 2004/0163811 A1 Aug. 26, 2004

Related U.S. Application Data

(60) Provisional application No. 60/448,357, filed on Feb. 19, 2003.

(51) Int. Cl.
*E21B 43/26* (2006.01)

(52) U.S. Cl. ..... 166/305.1; 166/373; 166/387; 166/186; 166/191

(58) Field of Classification Search ..... 166/305.1, 166/373, 387, 186, 191
See application file for complete search history.

(56) References Cited

U.S. PATENT DOCUMENTS 2,607,424 A 8/1952 Taylor
3,861,465 A 1/1975 Mignotte
3,964,544 A * 6/1976 Farley et al. ..... 166/374
4,671,352 A 6/1987 Magee, Jr. et al.
5,746,274 A * 5/1998 Voll et al. ..... 166/278
6,655,461 B1 12/2003 Eslinger et al.

FOREIGN PATENT DOCUMENTS

GB 2394735 A 5/2004

* cited by examiner

*Primary Examiner*—William Neuder
(74) *Attorney, Agent, or Firm*—Robin Nava; Tim Curington

(57) ABSTRACT

A formation treatment tool assembly is conveyed within a well casing by a tubing string and has a housing defining treatment fluid supply and discharge passages and a fluid injection port through which treatment fluid is directed from the supply passage into a packer isolated casing interval and a fluid inlet port permitting flow from the isolated casing interval to the fluid discharge passage. Spaced straddle packer elements of the tool are energized to establish sealing engagement with the well casing and define an isolated casing interval and are de-energized to retract from sealing engagement with the well casing and permit tubing conveyance. A dump valve connected with the tool housing is opened to permit flow of treatment fluid from the isolated casing interval through the treatment fluid discharge passage and is closed to confine treatment fluid to the isolated casing interval. A hydraulic or mechanically actuated tubing isolation valve is selectively closed to isolate the tubing string from casing or formation pressure and permit tool conveyance while maximizing the service life of the tubing string and to accommodate overpressured and underbalanced reservoir conditions.

21 Claims, 9 Drawing Sheets

FRACTURING TOOL HAVING TUBING ISOLATION SYSTEM AND METHOD

RELATED PATENT APPLICATION

Applicants hereby claim the benefit of U.S. Provisional Application Ser. No. 60/448,357 filed on Feb. 19, 2003 and entitled "Through Tubing Fracturing Isolation System & Method", which provisional application is incorporated herein by reference for all purposes.

BACKGROUND OF THE INVENTION

1. Field of the Invention

The present invention relates generally to formation fracturing systems for wells wherein treatment fluid, typically a slurry of a carrier liquid and sand or proppant, is pumped into an isolated perforated casing zone at sufficient pressure to fracture the surrounding production formation. Typically, proppant is caused to flow into the fractures and serves to prevent formation fractures from closing and thus maintain efficient fluid paths for propagation of production fluid from the formation to the well casing for production by tubing that is located within the casing. More particularly, the present invention concerns an isolation system that isolates the fluid column of a well service tubing string from either an overpressured or underbalanced reservoir condition.

2. Description of the Prior Art

When a fracturing treatment is performed on a zone isolated by packers possible common problems include (1) an overpressured reservoir condition and (2) an underbalanced reservoir condition. An overpressured reservoir condition is one in which the pressure of the reservoir is higher than the bottom hole pressure created by the hydrostatic column of fluid in the coiled tubing. This requires surface pressure to be applied to the coiled tubing to prevent the reservoir from producing up the coiled tubing. This applied surface pressure significantly decreases the life of the coiled tubing as it is cycled in and out of the wellbore. An underbalanced reservoir condition is one in which the hydrostatic pressure of a full column of fluid or slurry inside the coiled tubing creates a bottom hole pressure that is greater than the reservoir pressure and the casing/coiled tubing annulus pressure. The hydrostatic pressure typically results in the existence of a differential pressure across the straddle packer elements of a well service tool that prevents the tool from being moved to the next zone after having completed a well service activity at a selected zone within the casing.

SUMMARY OF THE INVENTION

It is a principal feature of the present invention to provide a novel tubing isolation system for well service tools such as fracturing tools, which achieves isolation of the fluid supplying and conveyance tubing string from well pressure and overcomes difficulties often encountered due to an overpressured reservoir condition or an underbalanced reservoir condition;

It is another feature of the present invention to provide a novel method for running, using and retrieving formation fracturing tools and accomplishing closure of a tubing isolation valve automatically responsive to sensing of predetermined formation pressure or mechanically by reciprocating movement of the tubing string for actuation of an isolation valve indexing mechanism.

While the present invention is discussed herein particularly as it concerns well service tools for formation fracturing, known in the industry as "FRAC tools" it is not intended to limit the spirit and scope of the present invention to formation fracturing operations. It will become apparent upon review of the following detailed description of the invention and the method by which the invention is employed, that the present invention has application in association with any kind of well service tool that is used to inject well treatment fluid of any sort into a subsurface formation surrounding a perforated zone of the well casing that intersects the formation. It will also be apparent that the present invention will have application in wells when well service tools are run into wells through tubing in a well casing or when run directly into the well casing of a well.

Briefly, the various objects and features of the present invention are realized through the provision of an isolation valve mechanism in connection with a well service tool, such as a formation fracturing tool, which is open to accommodate flow of fluid in either direction through the well service tool and which is closed for isolation of the tubing string from predetermined conditions of formation pressure, such as in the case of an overpressured reservoir condition or for isolation of the reservoir from the hydrostatic pressure of fluid within the tubing string, such as in the case of an underbalanced reservoir condition. This invention basically concerns methods and apparatus for isolating the treatment fluid supplying and tool conveyance tubing, such as coiled tubing or jointed tubing from a subsurface petroleum products bearing reservoir. By providing downhole isolation of the coiled tubing fluid column from the reservoir the disadvantages that are caused by an overpressured reservoir condition or an underbalanced reservoir condition, described above, can be overcome. This invention addresses problems that exist when a well is fractured through tubing (coiled or jointed) to an isolated interval. One example used for through-tubing fracturing is the oilfield service known as CoilFRAC™ provided by Schlumberger, where fracturing fluid is pumped down coiled tubing to an area of the wellbore or casing that is isolated by two opposing cup style straddle packer elements. Such services can be difficult or unavailable in wells having underbalanced or overpressured reservoir conditions as differential pressure accumulation across the coiled tubing from the formation undergoing treatment to the surface can negatively impact equipment, require excessive time and force to manipulate the pressured coiled tubing, or in certain situations create an unsafe working environments. The apparatus and method of the present invention provides means to isolate reservoir pressure in the isolated interval from pressure in the tubing and/or between the isolated zone and the remainder of the well bore or surface. Further in overpressured formations, the apparatus and methods of the present invention permit manipulation of other borehole tools or apparatus, such as a displacement valve, that may otherwise be restricted by the elevated pressure in the isolated interval. By providing an apparatus and method for isolating pressure between the tubing and the reservoir, the present invention allows coiled tubing to be moved in a lower stress condition, thereby improving the efficiency of the well treatment operation by avoiding high-differential pressure conditions that reduce the operating life of the tubing, present safety risks, and make movement of borehole equipment difficult. Thus the present invention improves the efficiency of the overall well treatment operation. The present invention is not limited to fracturing operations using coiled tubing but is also applicable to a number of different formation treatments that are performed on jointed pipe and are performed within isolated casing intervals that are created with a variety of straddle packer arrangements including mechanically set straddle packers, a mechanically set lower packer element and a service tool provided with a top cup packer element, or an arrangement using inflatable straddle packers.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof. It is to be noted however, that the appended drawings illustrate only a typical embodiment of this invention and are therefore not to be considered limiting of its scope, for the invention may admit to other equally effective embodiments.

In the Drawings.

DETAILED DESCRIPTION OF PREFERRED EMBODIMENT

Figure 1:
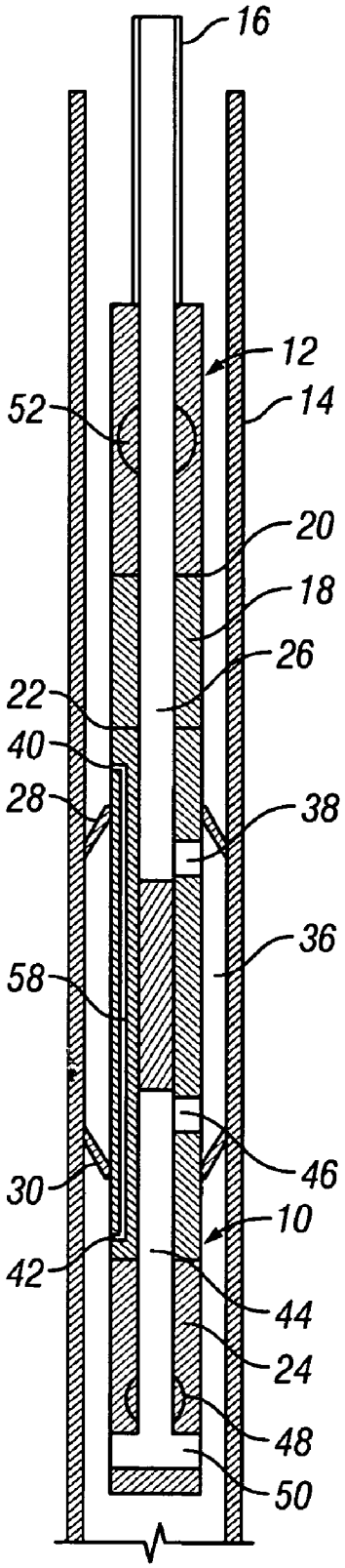
FIG. 1 is a schematic illustration of a well treatment tool, including a tubing isolation valve and a dump valve, being located within a well casing, such as during tool run-in, where the tool is moved through the well casing to the location of a desired interval.

In the following description, numerous details are set forth to provide an understanding of the present invention. However, it will be understood by those skilled in the art that the present invention may be practiced without these details and that numerous variations or modifications from the specifically described embodiments may be possible.

Referring now to the drawings and particularly to FIGS. 1–4 a well service tool shown generally at 10, having a tubing isolation valve shown generally at 12 is shown in running condition within a well casing 14. A tubing string 16, which may be composed of coiled tubing or jointed tubing, is connected to the tubing isolation valve 12 and extends to the surface where it is connected to surface equipment for supply of pumped formation treatment fluid, typically a slurry of a liquid carrier and coarse sand or other material which is typically referred to as proppant. The surface equipment is also capable of moving or controlling movement of the tubing string within the well casing for conveyance of the well service tool to desired zones and for retrieving the well service tool from the casing after well servicing, such as formation fracturing or other treatment has been completed. The well service tool 10 typically incorporates a pressure balanced disconnect apparatus 18 which is secured to the tubing isolation valve 12 by an upper connection 20 and secured to the well service tool 10 by a lower connection 22. To the lower portion of the well service tool 10 is connected a dump valve 24 which is closed to restrict the flow of formation treatment slurry to an isolated casing zone or interval, as explained below, and is opened to permit excess slurry to be discharged from the tubing string, well service tool and the isolated casing zone into the wellbore below the well service tool.

Figure 2:
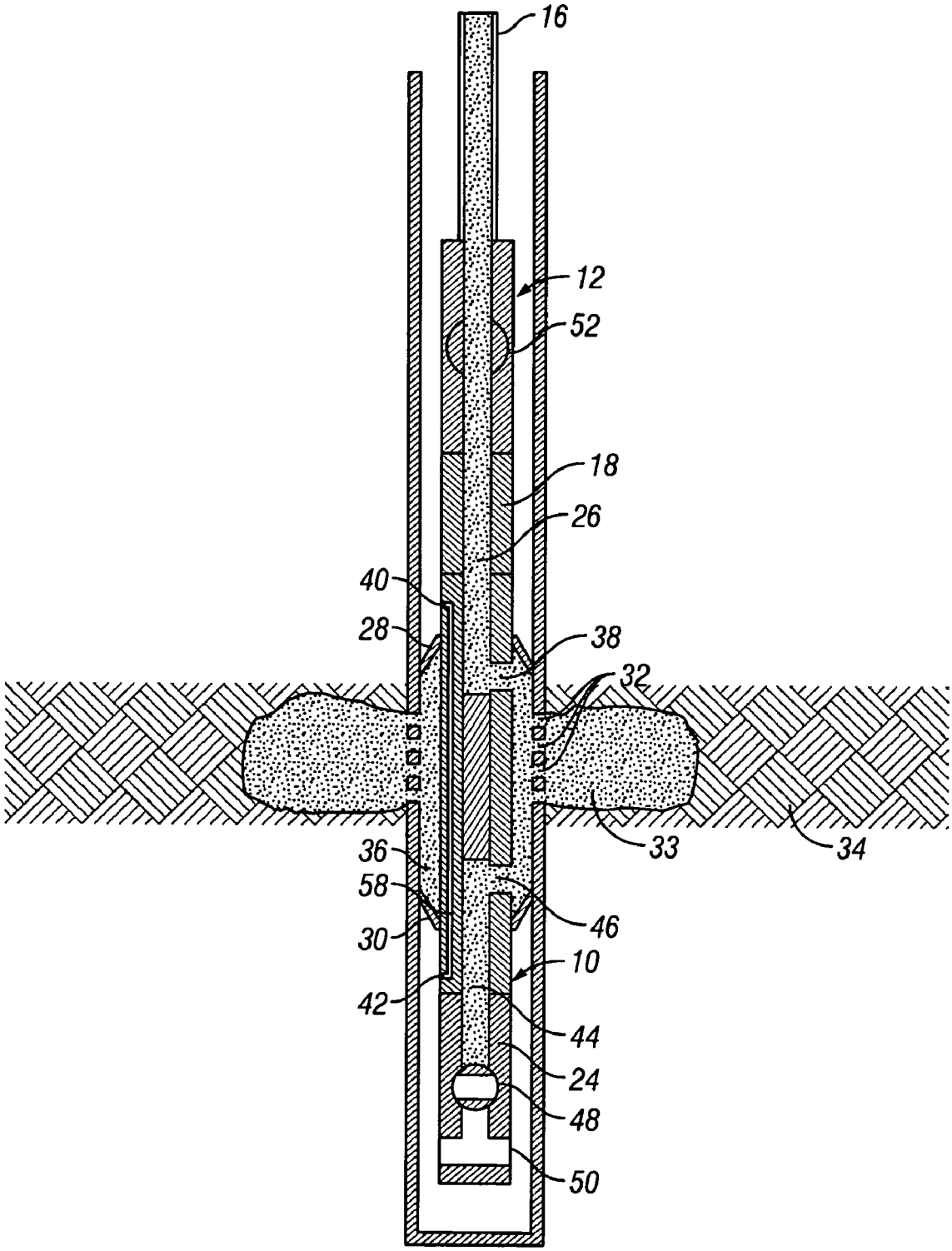
FIG. 2 is a schematic illustration similar to that of FIG. 1 and showing the well tool positioned so that its upper and lower packer elements straddle a perforated zone or interval of the well casing and further showing injection of treatment fluid into the isolated interval, with the dump valve closed and with the isolation valve open.

A fluid injection passage 26 is defined by the tubing string and by the tubing isolation valve, pressure balanced disconnect and the well service tool. To the well service tool 10 is mounted upper and lower packer elements 28 and 30, which may take the form of cup type packer elements as shown, inflatable packers or any other suitable packer elements. The packer elements are typically de-energized or contracted during running of the well service tool to permit the tool and all of its components to easily be moved through the well casing to the desired interval to be treated. Typically, the desired casing interval will have perforations 32 as shown in FIG. 2 which communicate the internal passage of the well casing with the surrounding formation 34. The packer elements, as shown in FIG. 2 establish sealing engagement with the internal wall surface of the well casing and define an isolated casing zone or interval 36. One or more injection or fracture ports 38 communicate the fluid injection passage 26 with the isolated casing zone or interval 36. When cup type packer elements are employed as the upper and lower packer elements 28 and 30 the pressure of injected well treatment fluid within the isolated casing zone or interval 36 causes energization of the packer elements for sealing thereof with the internal wall surface of the well casing. The packer elements are positioned to establish seals with the casing above and below a selected perforated zone of the casing and thus are known as straddle packer elements.

A by-pass passage 58 is defined by the well service tool 10 and has by-pass ports 40 and 42 located respectively above and below the upper and lower packer elements 28 and 30 and opening externally of the well service tool. As the well service tool is conveyed within the well casing displaced fluid within the well casing will flow through the by-pass passage, thus permitting more rapid conveyance of the well service tool than would otherwise be possible. When the well service tool has been sealed to the well casing, such as is shown in FIG. 2, fluid flow within the casing will by-pass the well service tool by flowing in either direction through the by-pass passage 58.

The dump valve 24 defines a dump passage 44 which is in communication with an inlet port 46 through with fluid treatment slurry may be caused to flow from the isolated interval 36 when it is desired to eliminate excess slurry, such as upon completion of formation fracturing and propping or other suitable treatment. A dump control valve 48 element is moveable within the dump valve mechanism 24 between open and closed positions to control the flow of excess slurry, flushing fluid and the like through the dump passage from the inlet port 46 to and through one or more dump ports 50 into the well casing below the well service tool. For purposes of simplicity in the schematic illustrations of FIGS. 1–4 the dump valve appears as a rotary valve such as a plug valve or ball valve; however the dump valve is typically provided in the form of a flow responsive poppet type valve which is closed by predetermined velocity of flow and is maintained closed by differential pressure. The dump valve may also take the form of a flow responsive sleeve valve or any other suitable type of flow responsive valve, without departing from the spirit and scope of the present invention. During formation fracturing or other treatment of the surrounding typically oil and gas bearing production formation 34, treatment fluid in the form of a slurry is pumped at high pressure through the tubing string and well service tool and through the fluid injection or fracture port or ports 38 into the packer isolated casing annulus zone or interval 36. At this time, the dump valve element 48 will have been closed by fluid flow, preventing flow of the treatment fluid slurry from the isolated interval through the inlet port 46 and dump passage 44, and, thereby causing the slurry pressure to be restricted to the isolated interval between the straddle packer elements. When the slurry pressure is sufficient to cause fracturing of the surrounding formation the treatment slurry will be forced through the casing perforations 32 and will propagate through the fractures as shown at 33. The coarse sand or proppant of the slurry will thereafter prevent consolidation of the fractured formation and will thus assist in maintaining production fluid flow paths from the formation to the perforations of the casing. After formation treatment has been completed, as evidenced by the schematic illustration of FIG. 3 the tubing string 16 and the isolated interval 36 typically contains excess treatment slurry. This excess slurry must be removed because it will otherwise interfere with deenergization of the packer elements and will prevent or retard conveyance of the well service tool to another position within the casing or retrieval of the well service tool from the casing. To eliminate the excess slurry, the dump valve 48 is opened and the slurry is displaced through the dump valve and into the well casing below the tool as shown. The excess slurry is preferably displaced into the casing by pumping a flushing fluid though the tubing string, through the well service tool into the isolated interval 36 although a majority of the slurry may be displaced into the well casing through the dump valve by injection of air or other compressed gas through the tubing string 16. With the dump valve element 48 open, the displaced slurry then enters the dump passage 44 via the inlet port or ports 46 and is conducted through the dump passage and is discharged into the casing via the dump ports 50.

Figure 5:
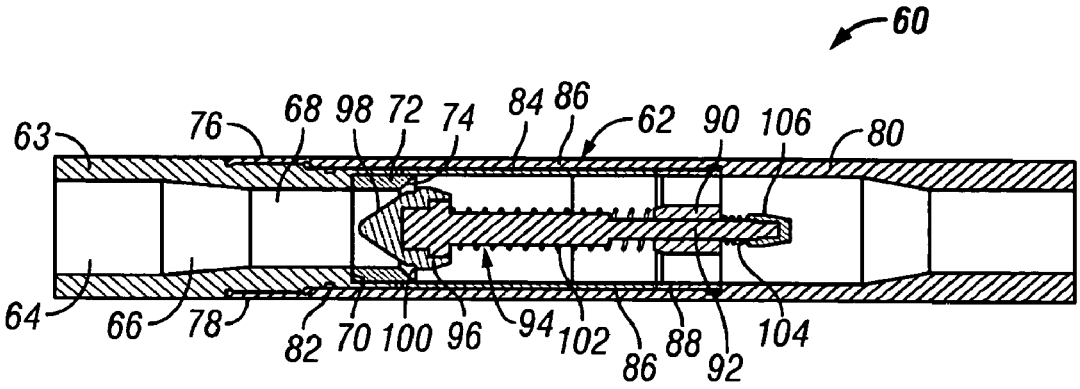
FIG. 5 is a longitudinal sectional view of a poppet type isolation valve, shown in its neutral condition, and which is connected to a well service tool and is responsive to fluid flow for opening and closure.
Figure 6:
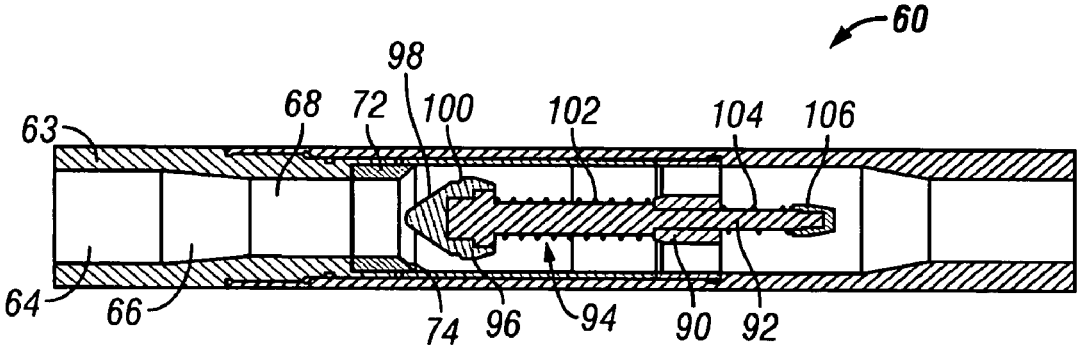
FIG. 6 is a longitudinal sectional view similar to that of FIG. 5 and showing the poppet valve element being moved by the force of fluid flow against the force of its primary spring, such as during relatively high velocity injection of pumped treatment fluid into the isolated interval and into the surrounding formation.
Figure 7:
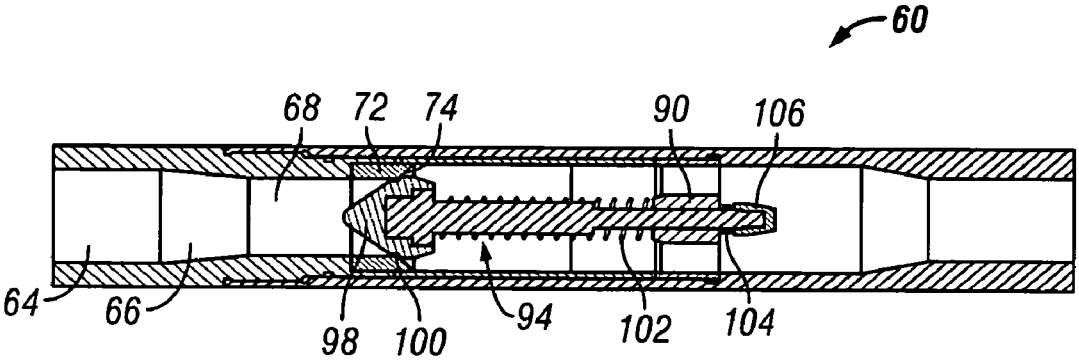
FIG. 7 is a longitudinal sectional view similar to that of FIGS. 5 and 6, showing the poppet valve element being closed against the force of its secondary spring, such as by formation pressure, for isolating the tubing string from formation pressure.

The tubing isolation valve mechanism 12 incorporates a moveable valve element 52 that is basically moveable between open and closed positions to permit the flow of pumped treatment slurry from the tubing string to the fluid injection passage of the well service tool assembly and to control communication of formation pressure to the tubing string. The moveable valve element 52 may conveniently take the form of a ball valve as shown in the schematic illustrations of FIGS. 1–4 and in FIGS. 8 and 9, or it may take the form of a linearly moveable poppet valve, as shown in FIGS. 5–7 or a linearly moveable tubular sleeve valve or any other suitable type of hydraulically or mechanically actuated valve without departing from the spirit and scope of the present invention. It is only necessary that the tubing isolation valve mechanism be capable of opening and closing movement in the downhole environment hydraulically responsive to fluid flow or pressure, or mechanically, such as by cycling movement of the tubing string or by any other suitable means.

Figure 4:
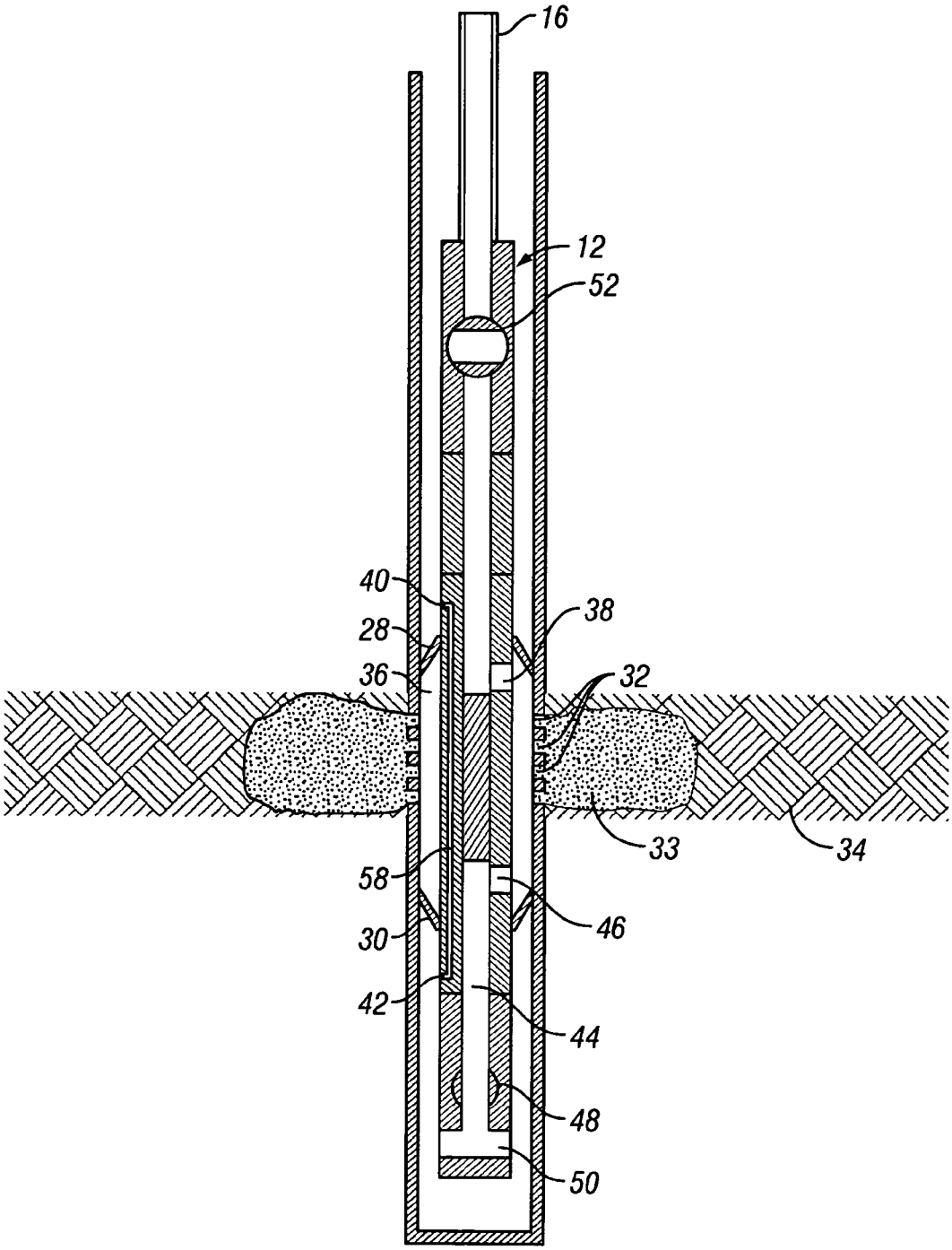
FIG. 4 is a schematic illustration similar to that of FIGS. 2 and 3 and showing the dump valve open and the isolation valve closed to isolate the tubing string from the casing pressure

In the schematic illustration of FIG. 4 the well treatment tool assembly 10 is shown after well treatment has been completed and after excess formation treatment slurry has been displaced or flushed from the tubing string 16, the well service tool 10 and the isolated interval 36. The tubing isolation valve 52 is shown at its closed position so that the formation pressure is isolated from the tubing string, allowing the pressure of the tubing string to be reduced or dissipated. As indicated above, it is desirable that coiled tubing be depressurized during conveyance of the well service tool within the well casing so that the service life of the tubing string will not be compromised by bending of the tubing under pressure. The schematic illustration of FIG. 4 also shows the dump valve 48 at its open position, thus communicating the well casing with the isolated interval and with the by-pass passage 58 communicating casing pressure across the straddle packer elements 28 and 30. This causes the pressure across the packer elements 28 and 30 to become balanced, so that the pressure responsive packer elements will retract from their sealed contact with the casing. When the packer elements are balanced the packer elements release their sealing engagement with the casing and the well service tool can then be conveyed upwardly for retrieval or conveyed downwardly or upwardly to another selected perforated zone of the casing, where the fracturing or other well treatment operation can be repeated.

Flow Operated Tubing Isolation Valve

Referring now to FIGS. 5–7, a flow responsive tubing isolation valve representing an embodiment of the present invention is shown generally at 60 which comprises a poppet type flow actuated tubing isolation valve mechanism having a valve element that has a neutral position (FIG. 5) being slightly spaced from the valve seat, such as for tool run-in or other conditions of nominal fluid flow, and being moved downwardly to a full open position (FIG. 6) by the relatively high velocity flow of formation treatment slurry during formation treatment or moved to its closed position (FIG. 7) by formation pressure. The tubing isolation valve 60 comprises a valve housing shown generally at 62 and upper housing section 63 to which is typically mounted a tubing connector element that receives a tubing connector of the lower or leading end of a tubing string. The valve housing section 63 has a flow passage 64 which is defined partially by a tapered section 66 and a smaller diameter cylindrical section 68 that causes the velocity of fluid flow to be increased just before it reaches the valve element. The valve housing section 63 defines an internal seat recess 70 within which is secured an annular valve seat 72 having a tapered sealing surface 74. The valve housing section 63 has an externally threaded section 76 to which is connected an internally threaded upper end 78 of a lower housing section 80 and is sealed therewith by an annular sealing element 82. The upper and lower housing sections cooperatively define an annular receptacle within which is located a tubular spacer element 86 and a valve retainer element 88. The valve retainer element is in the form of a support spider, having a central bushing 90 defining a central passage within which is moveable the elongate shank or stem 92 of a poppet valve element shown generally at 94. The poppet valve element 94 is provided with a valve head 96 having a generally conical upwardly facing end 98 which, at the neutral position shown in FIG. 5, is located partially within the central flow passage opening of the annular valve seat 72 and is slightly spaced from the tapered seat surface 74 to permit nominal flow through the isolation valve mechanism. The valve head 96 also defines an annular seat shoulder 100 which establishes seating engagement with the annular tapered sealing surface 74 of the annular valve seat 72 when the valve head is moved to its closed position.

A primary helical spring 102 is located about an upper end section of the valve stem and has an upper end engaging the valve head 96 and a lower end engaging the central bushing 90. The primary helical spring 102 provides the poppet valve element 94 with an urging force tending to urge the poppet valve element toward its closed position. A secondary helical spring 104 is positioned about the lower end section of the valve stem and has its upper end disposed in force transmitting engagement with the central bushing 90 and its lower end shouldered against a spring retainer element 106. The secondary helical spring 104 imparts an urging force to the valve stem tending to urge the valve head 96 in a direction away from the annular valve seat 72. Cooperatively, in absence of other forces acting on the poppet valve element 94, the primary and secondary springs function to position the valve element at its neutral position with the valve head slightly spaced from the valve seat as shown in FIG. 5. As the well service tool is run through the casing, any displaced fluid will flow through the slight valve opening since the velocity of flow will be fairly low. At higher fluid flow velocity the poppet valve element 94 will either be moved to its more open condition as shown in FIG. 6 or its closed position as shown in FIG. 7, depending on the direction of fluid flow.

With fluid flow down the coiled tubing 16, which occurs during pumping of formation treatment fluid from the surface, fluid flow around the poppet valve element creates a pressure drop across the poppet which compresses the primary spring 102 and causes the poppet valve element 94 to move to the full open position as shown in FIG. 6. When the downward fluid flow is stopped, the valve element 94 is returned by the force of its primary and secondary springs to the neutral position shown in FIG. 5. At low rate fluid flow, less than 2 bbl per minute (0.25 $m^3$ per minute) in the upward direction, the force of the secondary spring 104 holds the poppet valve element 94 in the neutral or FIG. 5 position. Increased upward flow through the tubing isolation valve 60 causes a pressure drop in the restricted area between the valve seat surface 74 and the valve head 96 of the poppet valve element 94. The force of the secondary spring 104 keeps the valve open until the product of the pressure drop and the seat area exceeds the spring force of the secondary spring. This will cause the tubing isolation valve to close as shown in FIG. 7. The poppet valve element 94 will then remain closed until the pressure differential across the valve seat is reduced to near zero, such as when pressure across the valve element is substantially balanced, whereupon the secondary spring 104 will unseat the valve element and the primary and secondary springs will return the valve element to its neutral position.

METHODS OF OPERATION

To solve problems encountered with overpressured reservoirs and underbalanced reservoirs an isolation valve has been added to the downhole treatment tool string as shown in FIG. 1. Two methods of operating the isolation valve are disclosed below. Method 1 uses flow either down or up the coiled tubing to open and close the valve. Method 2 uses reciprocation of the coiled tubing string to operate the valve.

Overpressured Wells

For overpressured wells, when a significant amount of surface pressure (>200 psi) (1380 kPa) is present at the wellhead then the isolation valve would be closed, FIG. 4, to run in the hole. The closed valve would keep the wellhead pressure off of the coiled tubing while it is run into the well. This is important since coiled tubing life is adversely affected when it is bent (at the reel and the injector gooseneck) with pressure inside the tubing. After a fracture treatment has been performed on the straddled zone and the slurry cleaned out of the coiled tubing the isolation valve would be closed and coiled tubing pressure reduced so that the tool could be positioned at the next zone or removed from the well. As stated above, this prevents additional damage to the coiled tubing from cycling with pressure inside the tubing.

Underbalanced Wells

For underbalanced wells, (when the fluid level is >500 feet (152 m) from surface) the tubing isolation valve will normally be closed during running of the well service tool into the well casing. The closed tubing isolation valve keeps the hydrostatic pressure created by the column of fluid inside the coiled tubing from acting on and potentially damaging the underpressured reservoir. After a fracture treatment has been performed on the straddled zone the isolation valve will be caused to remain closed. This will allow the pressure in the isolated zone to equalize with the reservoir pressure and will isolate the CoilFRAC™ well service tool from the hydrostatic pressure caused by the underflushed slurry column in the coiled tubing. This reduction in pressure of the treated zone will allow the dump valve to open at a lower differential pressure than is currently possible. When the dump valve opens, the slurry can be cleaned out of the coiled tubing by pumping it into the wellbore below the straddle packer, such as by injecting air or a suitable gas into the tubing string at the surface. With the dump valve open, the wellbore pressure and the treated zone pressure become equalized, while the isolation valve keeps the hydrostatic pressure of the coiled tubing from acting on the well. With the downhole pressures equalized the straddle packers become unsealed with respect to the well casing and retract so that the well service tool may be moved to the next zone or removed from the well.

The schematic illustration of FIG. 1 shows a well service treatment tool assembly with a dump valve and a tubing isolation valve in the "running" or "run in hole" position, such as when the service tool assembly is being conveyed through the well casing by movement of the tubing string. FIG. 5 shows the flow operated isolation valve of the well service tool assembly in the run-in-hole position. As the well service tool assembly is run into the well the coiled tubing may fill up as fluid flow occurs through the partially open poppet valve. The valve is designed so that the tubing string can be run in hole at a velocity of about 2 bbl per minute (0.25 $m^3$ per minute) without the valve closing. Upward flow of fluid through the valve causes a pressure drop in the restricted area between the valve seat and the poppet. The force from the secondary spring 104 keeps the valve open until the product of the pressure drop and the seat area exceeds the spring force. This will cause the poppet valve element 94 to be moved to the closed position shown in FIG. 7 against the force of the primary spring 102. If the poppet valve element 94 accidentally closes due to a fluid surge or excessive run in hole rate, the valve element can be easily moved to its open position by pumping down the coiled tubing, which develops sufficient pressure responsive force acting on the valve element to overcome the combined force of pressure differential and secondary spring force to move the valve poppet off of the valve seat surface 74.

Just prior to reaching the perforated intervals the downhole tool system may be tested, though such testing is not mandatory. The straddle formation treatment tool is placed in a non-perforated section of casing, typically immediately above or below the casing perforations and the flow responsive dump valve 24 is closed by pumping down the coiled tubing at a predetermined rate. The fluid flow down the coiled tubing forces the flow operated isolation valve 60 to the full open position as shown in FIG. 6. When the dump valve 24 closes, fluid is forced into the non-perforated casing area isolated by the straddle packer elements 28 and 30, resulting in a rapid rise in pressure, at which point the pumps are stopped. When the fluid flow stops the flow responsive tubing isolation valve is returned to the neutral position shown in FIG. 5 by the primary and secondary helical springs. The pressure is then slowly bled off of the coiled tubing at the surface. Due to the controlled bleed rate the tubing isolation valve 60 remains open allowing the differential pressure across the cup packer elements 28 and 30 and the flow responsive dump valve seat to be dissipated. The dump valve is then opened, causing pressures to equalize and permitting the formation treatment tool to be conveyed by the tubing string to the first perforated interval as shown in FIG. 2.

With the straddle tool assembly located at the zone of interest, the dump valve 24 is closed by pumping down the coiled tubing. When the dump valve closes, fluid is forced into the formation isolated by the straddle packer elements 28 and 30. The fluid flow and pressure are increased until the selected zone fractures and slurry is pumped into the fractures of the formation as shown in FIG. 2. During this high flow rate operation the poppet valve element 94 of the flow operated isolation valve mechanism 60 is forced to the full open position shown in FIG. 6 against the spring force of the primary spring 102. Due to the large flow area around the poppet valve element the erosion of the valve mechanism can be controlled to an acceptable limit.

Figure 3:
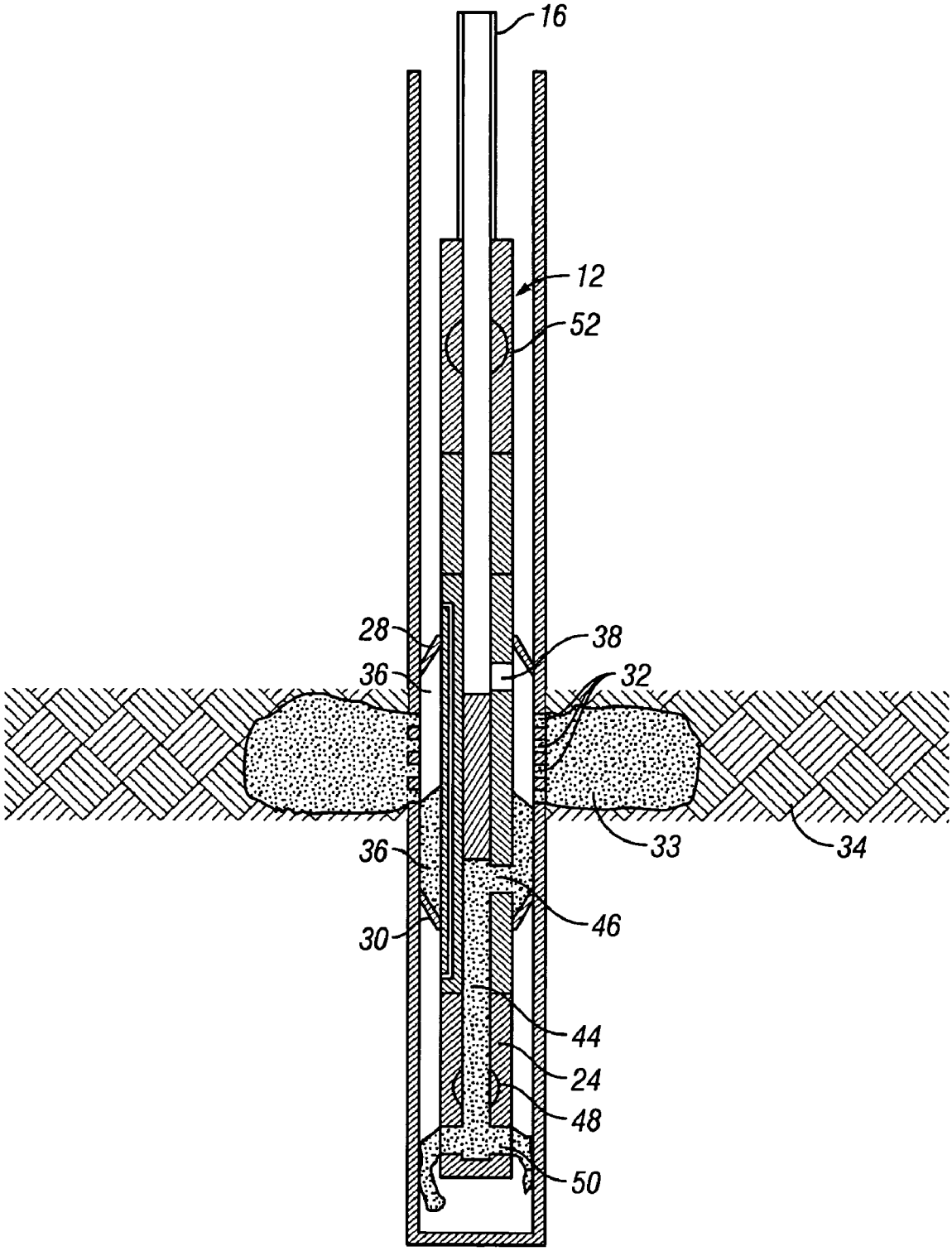
FIG. 3 is a schematic illustration similar to that of FIG. 2 and showing a condition subsequent to completion of formation fracturing and proppant injection where the isolation valve and the dump valve are both open, such as during displacement of excess treatment slurry into the casing below the well service tool via the dump valve.

After the selected formation zone has been fractured, some treatment fluid slurry remains in the coiled tubing and in the annular area between the casing and the straddle tool. Tubing pressure is then bled off at the surface at a rate that will not close the isolation valve. As the pressure lowers, the dump valve spring overcomes the force created by the differential pressure across the dump valve seat and the dump valve will be opened by its spring. With the dump valve open, clean fluid is pumped down the coiled tubing, through the straddle tool and the isolated casing zone and then out the dump valve into the well casing below the straddle packer, as shown in FIG. 3, thus cleaning the straddle tool and the isolated casing zone and preparing the formation treatment tool for conveyance to another selected casing interval or for removal of the well service tool from the casing. With the pressures equalized across the cup packer elements 28 and 30 and inside the coiled tubing and the casing annulus, the tool is moved to the next zone and the process is repeated.

Overpressured Well Treatment Procedure

As mentioned above, FIG. 1 shows a tool assembly in the run in hole position. FIG. 5 shows the flow operated isolation valve of the tool assembly 10 in the run-in-hole position. In an overpressured well, the coiled tubing would be filled with fluid before it is connected to the wellhead. When the wellhead is opened the well service tool 10 and the coiled tubing 16 will be pressured to the wellhead surface pressure. Since there is no flow up the coiled tubing at this point the flow operated tubing isolation valve mechanism would be in the neutral position shown in FIG. 5. To close the tubing isolation valve the coiled tubing valve is opened at the surface, which allows casing fluid to flow up the coiled tubing. This sudden fluid surge closes the tubing isolation valve mechanism 60 as shown in FIG. 7 (see above for description of closing mechanism). With the tubing isolation valve element 94 closed, the coiled tubing 16 can then be run-in-hole with a controlled differential. Pressure testing and fracturing are then accomplished by a procedure that may be identical to the description that is set forth above.

After the selected zone has been fractured, some slurry normally remains in the coiled tubing and in the annular area between the casing and the straddle tool. Tubing pressure is bled off at the surface at a rapid rate which will close the isolation valve mechanism 60. The coiled tubing pressure is then reduced to the desired pressure while the reservoir pressure is isolated from the coiled tubing. In some formations the pressure of the fractured interval will return to the "prefrac" pressure rapidly. When this occurs the pressure differential across the dump valve seat is reduced until the dump valve opens. In tight formations this pressure equalization may not occur rapidly. In this case pressure can be applied at the surface to the casing/coiled tubing annulus until the differential pressure across the dump valve seat is low enough for the dump valve spring to open the valve.

With the dump valve 24 open, clean fluid is pumped down the coiled tubing 16, through the straddle tool and out the dump valve into the wellbore below the straddle packer elements 28 and 30 as shown in FIG. 3. At this point the coiled tubing pressure is bled off at the surface at a rapid rate, which will close the tubing isolation valve mechanism 52 as shown in FIG. 4. The coiled tubing pressure is then reduced to a desired pressure while the reservoir pressure is isolated from the coiled tubing string. The straddle packer formation treatment tool assembly can then be moved to the next perforated interval or extracted from the well casing as desired.

Reciprocation Actuated Tubing Isolation Valve

A mechanically actuated embodiment of the present invention which is shown in FIGS. 8A to 8D, and 9A to 9D, comprises a tubing isolation valve mechanism identified generally at 110 which may conveniently take the form of a tubing reciprocation operated tubing isolation valve which is cycled to a plurality of operating conditions by controlled upward and downward cycling of the tubing string that is used for running the well service tool and for conducting formation or reservoir treatment using the tool. FIGS. 8A through 8D show the tubing isolation valve mechanism (110) actuated to its open condition. Though a straddle packer type formation treatment tool may be run into the casing with the valve open, preferably, in accordance with the method of operation set forth herein, the valve will typically be in its closed condition, such as shown in FIGS. 9A through 9D during tool running operations. Though the tubing isolation valve mechanism 110 of FIGS. 8A to 8D, 9A to 9B is shown to be provided with a mechanically actuated rotatable ball valve mechanism, it is to be borne in mind that the tubing isolation valve may take the form of a mechanically actuated linearly moveable sleeve valve or any other suitable mechanically actuated valve within the spirit and scope of the present invention. The mechanically actuated tubing isolation valve 110 is thus intended to represent only one of a number of embodiments that are possible within the spirit and scope of the present invention.

The tubing isolation valve 110 includes a valve section shown generally at 112, a valve position indexing section shown generally at 114 and a force resisting section shown generally at 116. The valve section 112 incorporates a connector element 118 which is adapted for sealed connection to the lower connector end of a tubing string that extends from tubing handling equipment at the surface to the well service tool. For ease and simplicity of running, cycling and retrieving the well service tool, the tubing string is preferable a coiled tubing string though such is not required for practicing the present invention, since tubing of other character may be employed as well. A seat retainer coupling 122 is connected in sealed relation to the connector element 118 and also serves as a coupling member to which a tubular valve housing 124 is connected and sealed. The tubular valve housing 124 defines a valve chamber 126 within which a valve ball member 128 is mounted for rotation about trunnions 130 that are components of a valve ball mount 132. A tubular seat and piston guide element 134 is positioned in closely spaced relation with the tubular valve housing 124 and serves to position and guide a tubular valve seat element 136. The tubular valve seat element 136 defines an annular seat recess within which is located a seat assembly 138 having a resilient or polymer seat component and two antiextrusion seat rings that establish sealing with the spherical sealing surface 140 of the valve ball member 128. The tubular valve seat element 136 is urged to sealing engagement with the valve ball member by a compression spring 142 having an upper end there bearing against a support shoulder within the seat retainer coupling 122 and having the lower end thereof bearing against a circular spring follower 144 that establishes force transmitting engagement with a tubular extension of the tubular valve seat element 136.

The seat retainer coupling 122, tubular seat guide element 134 and the tubular seat element 136 cooperate to define an annular piston chamber 146 within which is located a tubular bias piston 148 that is sealed to the seat retainer coupling 122 by an external annular piston seal 150 and is sealed to the tubular extension of the tubular valve seat element by an internal annular piston seal 152. The sealing diameters of the internal and external piston seals 150 and 152 are such, as compared with the sealing diameter of the seat assembly 138 that pressure within the flow passage 154, with the valve ball open, urges the seat assembly toward the valve ball member and thus enhances the sealing capability of the valve mechanism. The sealing diameters of the internal and external piston seals 150 and 152 are such, as compared with the sealing diameter of the seat assembly 138 that pressure within the flow passage 260, with the valve ball closed, urges the seat assembly toward the valve ball member and thus enhances the sealing capability of the valve mechanism. For actuation of the valve ball member 128 between its open and closed positions, the tubular valve ball mount 132 defines a cylindrical internal guide surface 156 which serves as a guide for a linearly moveable tubular valve actuator member 158, having at least one and preferably a pair of actuator pins that engage within actuator slots 162 of the valve ball member 128. The actuator slots are of a configuration to react with the linearly moveable actuator pins 160 and cause 90° rotation of the valve ball to its open or closed position, depending on the direction of linear movement of the tubular valve actuator member 158.

An indexing sleeve 164 is provided with a connector 166 at its upper end that establishes rotatable connection with the lower connecting end 168 of the tubular valve actuator member 158. A rotatable coupling 167 is provided at the rotatable connection and ensures that the rotary movement of the indexing sleeve, during indexing activity, will not cause rotation of the tubular valve actuator member 158. The rotary coupling, however, secures the indexing sleeve and the valve actuating member 158 in linear assembly so that linear movement of the indexing sleeve causes consequent linear movement of the valve actuator member. The connection established by the connector 166 and the connecting end 168 permits rotary movement of the indexing sleeve 164 relative to the tubular valve actuator member 158 while maintaining linear connection between them. This feature permits the indexing sleeve 164 to be rotated during valve position indexing while the tubular valve actuator member 158 is permitted only linear movement for actuating the valve ball member to its open or closed positions. The tubular valve housing 124 is provided with an internal connection collar 170 to which the lower end portion of the valve housing 124 is connected and sealed and to which a lower housing closure fitting 172 is also connected and sealed. The housing closure fitting 172 defines an internal shoulder 174 which serves as a retainer shoulder for maintaining the position of an annular indexing sleeve guide element 176 which defines an annular slot that provides for rotational control of the indexing sleeve 164. The indexing sleeve 164 defines an external boss 178 which traverses the annular slot and limits linear movement of the indexing sleeve 164 and the tubular valve actuator member 158 both during valve opening and closing actuation. The lower housing closure fitting 172 is provided with a downwardly extending tubular extension 180 which defines an external cylindrical surface 182. Internally, the downwardly extending tubular extension 180 defines an internal cylindrical guide surface 184 which serves to guide the indexing sleeve 164 during its rotary and linear movement relative to the valve housing 124. Seal assemblies 186 and 187 maintain sealing between the indexing sleeve 164 and the internal cylindrical guide surface 184 of the tubular extension 180 during valve actuation and straddle the linear guide and indexing slots to isolate the indexing mechanism from any fluid pressure that might be present within the flow passage of the tubing isolation valve mechanism.

The indexing section 114 of the tubing isolation valve assembly defines an indexing housing shown generally at 188 and being composed of an intermediate indexing housing sub 190 and upper and lower indexing housing subs 192 and 194. The upper indexing housing sub 192 carries an annular internal debris scraper 196 within an internal annular seal groove, with the scraper disposed in scraping engagement with the external cylindrical surface 182 of the tubular extension 180 and thus preventing debris from entering between the indexing housing 188 and the tubular valve housing 124 during relative indexing movement. The intermediate indexing housing sub 190 defines a guide receptacle 198 within which is located an indexing guide element 200. A retainer head 202 of the indexing guide element 200 is received within the guide receptacle and is thus retained in substantially fixed position relative to the intermediate indexing housing sub. An intermediate section 204 of the indexing guide element 200 is received within a substantially straight linear control slot 206 that is formed in the tubular extension 180 of the lower housing closure fitting 172. The annular seal assemblies 186 and 187 are carried within external seal grooves of the indexing sleeve 164 and establish sealing with the internal cylindrical guide surface 184 of the tubular extension 180 as indicated above and thus isolate the linear control slot 206 and the indexing slot 210 from the pressure of fluid within the flow passage of the valve and valve indexing mechanisms. An innermost indexing section 208 of the guide element 200 is located within an indexing slot 210 which opens externally of the indexing sleeve 164 and has a geometric configuration that is typically known in the industry as a "J-slot" and which interacts with the guide element 200 to achieve selective rotational indexing of the indexing sleeve to its four or more positions responsive to linear cycling movement of the indexing sleeve and to thus establish selective operational modes of the tubing isolation valve 110. It should be noted that the indexing housing 188 is disposed in telescoping relation with the downwardly extending tubular extension 180 of the lower housing closure fitting 172, with the annular debris scraper 196 exclusing debris from between the indexing housing and the tubular extension during the telescoping movement that occurs from mechanical linear cycling movement of the tubular isolation valve mechanism.

Figure 8A:
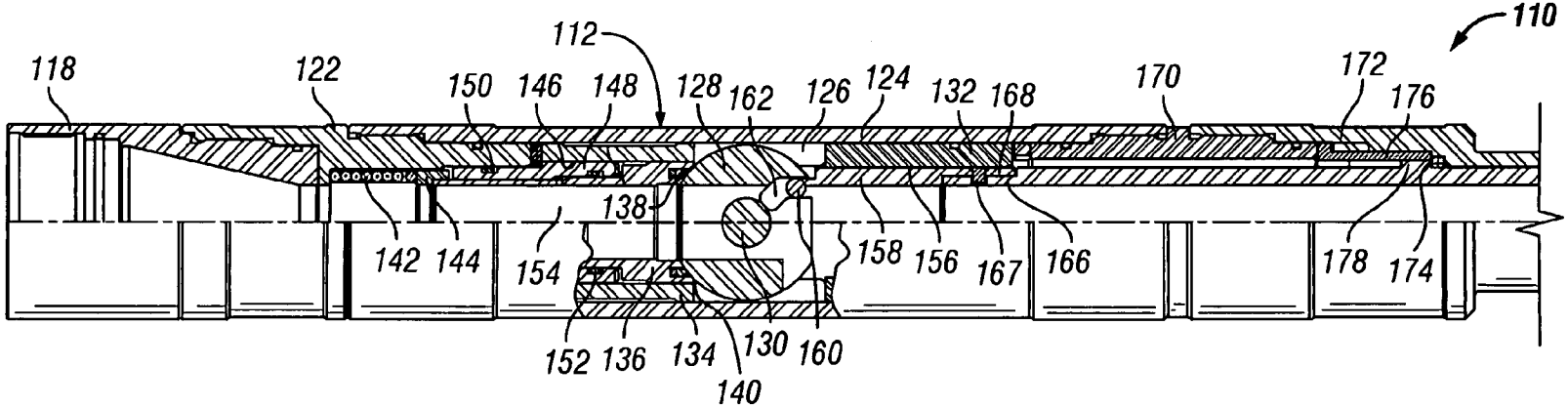
FIG. 8A is a longitudinal sectional view showing the valve section of a ball type tubing isolation valve and valve actuator mechanism which is designed for connection to a well service tool and is actuated to its open and closed positions by reciprocation of a tubing string.
Figure 8B:
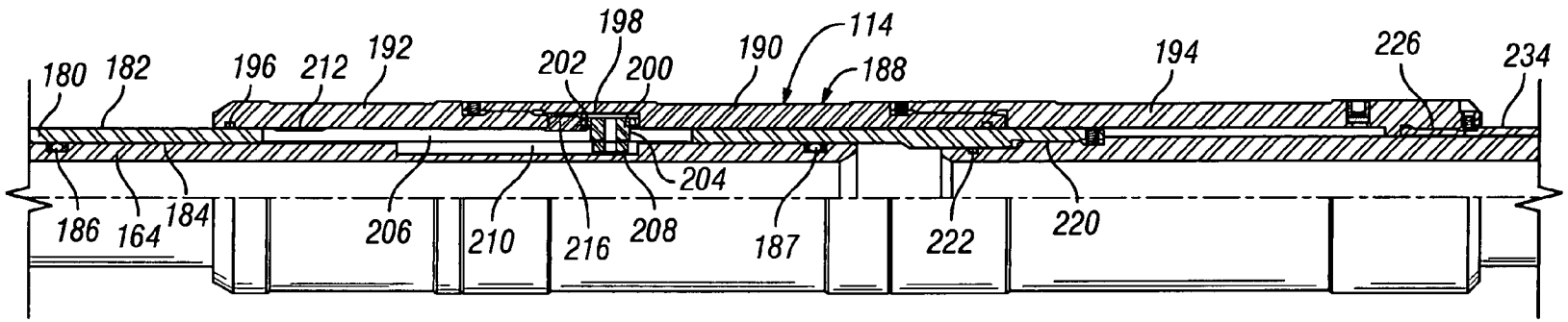
FIG. 8B is a longitudinal sectional view showing a valve position indexing section of the ball type tubing isolation valve and valve actuating mechanism of FIG. 8A, with the valve mechanism being shown in the open position thereof.
Figure 8C:
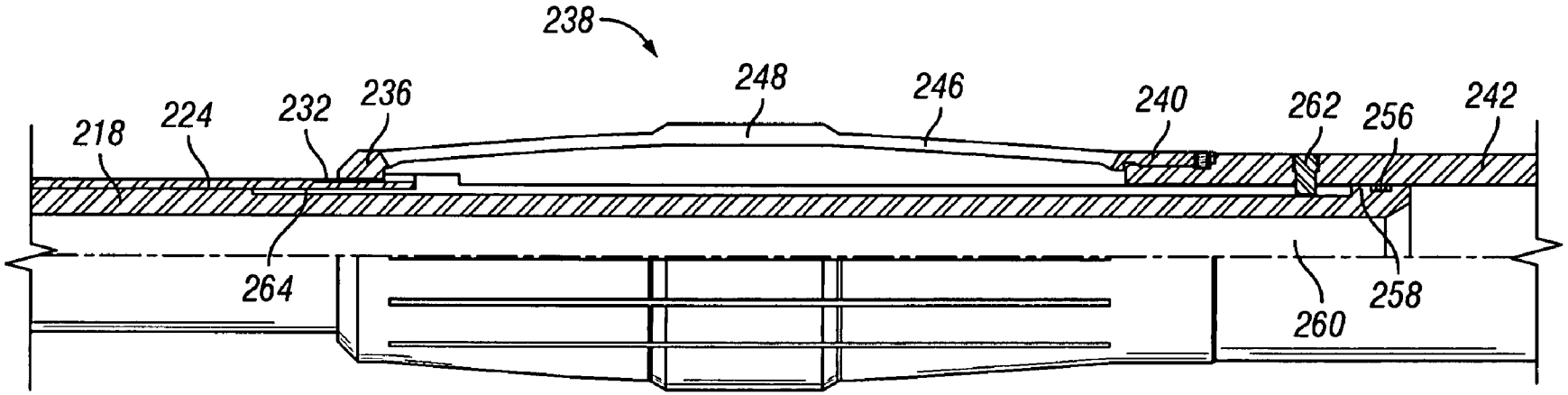
FIG. 8C is a longitudinal sectional view showing a force resisting section of the valve and valve actuator mechanism of FIGS. 8A and 8B.
Figure 8D:
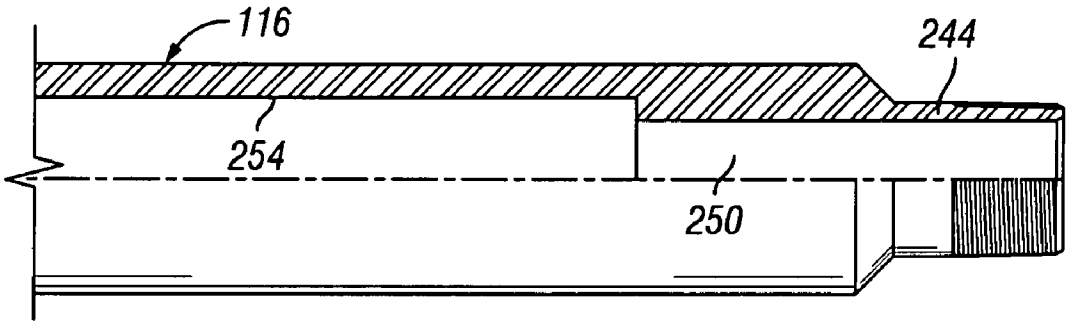
FIG. 8D is a longitudinal sectional view showing the lower connecting end of the valve and valve actuator mechanism of FIGS. 8A, 8B and 8C, showing the telescopically extended condition of the force resisting mechanism of FIG. 8C.
Figure 9A:
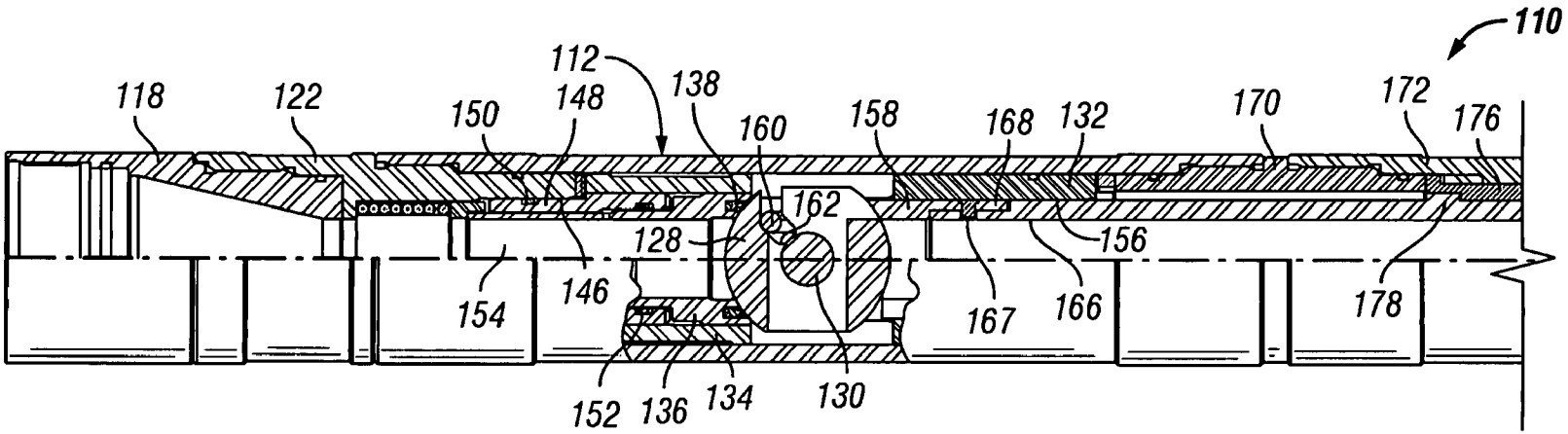
FIG. 9A is a longitudinal sectional view showing the upper portion of the ball type tubing isolation valve of FIGS. 8A–8C with the valve ball thereof being shown at its closed position.
Figure 9B:
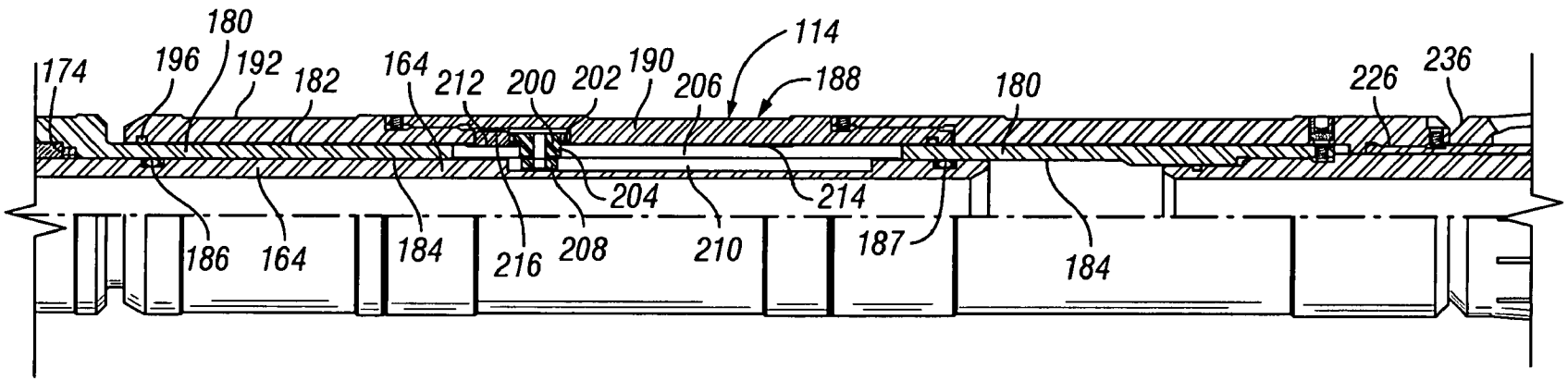
FIG. 9B is a longitudinal sectional view showing the valve closed position of the valve position indexing section of the ball type tubing isolation valve of FIGS. 8A and 8B.
Figure 9C:
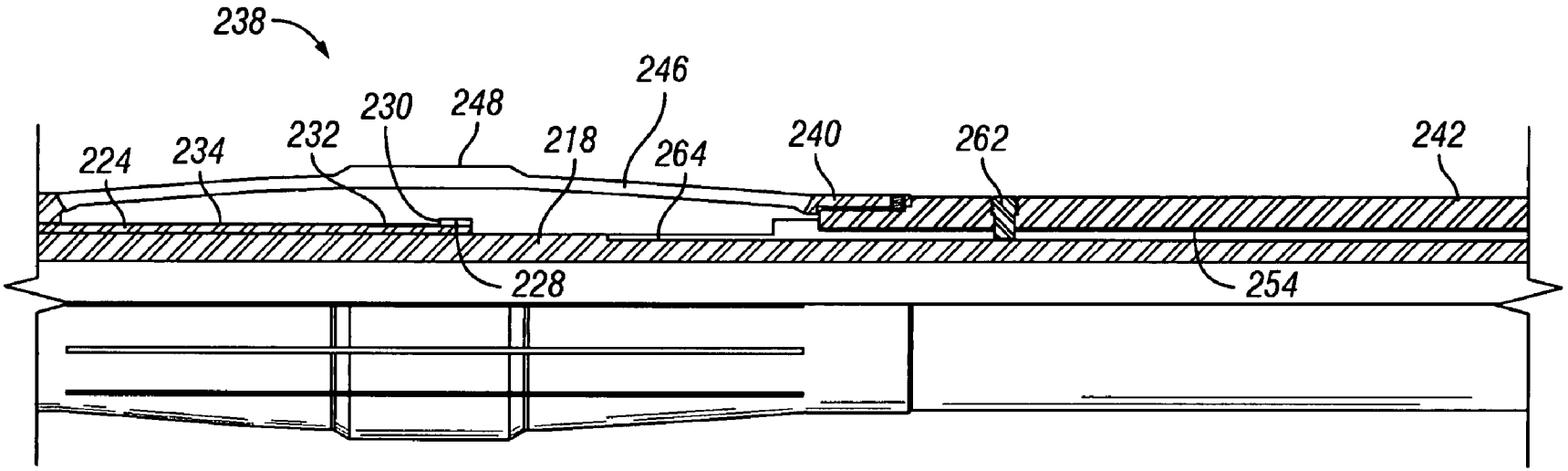
FIG. 9C is a longitudinal sectional view showing the telescopically collapsed position of the force resisting mechanism of FIG. 8C.
Figure 9D:
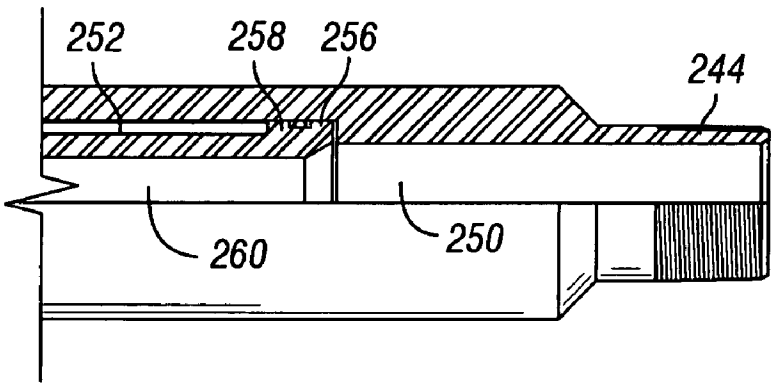
FIG. 9D is a longitudinal sectional view showing the lower connecting end of the isolation valve and valve actuating mechanism at the telescopically collapsed position thereof.

In FIGS. 8A and 8B the indexing housing 188 is shown with the valve housing assembly at the upper extent of its linear travel, via upward movement of the tubing string, so that the guide element 200 is located within the lower portion of one of the multiple legs of the indexing slot geometry 210. As the valve housing and indexing housing are moved relatively to their telescopically closed or collapsed condition as shown in FIGS. 9A and 9B, the guide element 200 traverses the straight linear control slot 206 and also traverses the indexing or J-slot geometry, with the innermost indexing section 208 of the guide element 200 reacting with the indexing slot geometry and causing incremental rotational movement to the indexing sleeve and at the same time traversing the axial length of the indexing slot. This indexing movement occurs when the tubing isolation valve mechanism is subjected to a set-down force by moving the tubing string downwardly while subjecting the lower portion of the tubing isolation valve mechanism shown in FIGS. 9C and 9D to resistance against the set-down force, and then subsequently moving the tubing string upwardly against the resistance of a drag block and/or the straddle packer elements. As indicated below, resistance to the set-down force can be accomplished by an optional drag block shown in FIGS. 8C and 9C or it can be accomplished by force resistance that is established by the straddle packer elements of the well service tool. It is appropriate for the indexing mechanism of the tubing isolation valve be provided with means establishing certain resistance to both telescopically collapsing and telescopically extension movement. To accomplish this feature the indexing sleeve 164 is provided with axially spaced external detents 212 and 214 that are engaged by a flexible C-ring 216 that is secured in position against an internal shoulder of the intermediate indexing housing sub 190 by the upper indexing housing sub 192. With the flexible C-ring located within one of the spaced detents 212 and 214 a predetermined axial force, for example 1000 lbs. (454 kgs), more or less, is required to move the flexible C-ring out of the detent and permit telescopic collapsing or extension movement of the indexing housing. This controlled release feature minimizes the potential for inadvertent telescoping movement of the indexing housing relative to the valve housing and thus also minimizes the potential for inadvertent opening or closing movement of the tubing isolation valve mechanism.

A support and guide tube 218 is connected and sealed to the tubular sleeve 180 by a threaded connection 220 having an annular sealing element 222 and is telescopically moveable within the indexing housing 188 and within a guide tube 224 that is connected to the lower indexing housing sub 194 by a threaded connection 226. At the lower end of the guide tube 224 there is defined an annular flange 228 having an upwardly facing stop shoulder 230 and several debris relief slots 232 which pass through the annular flange.

The support and guide tube 218 provides support for the guide tube 224 and the guide tube provides an external cylindrical guide surface 234 which is engaged by an annular guide ring 236 that defines the upper end of a drag block member shown generally at 238. An annular lower end section 240 of the drag block member 238 is threaded to a lower housing mandrel 242 which is provided with a threaded connection 244 for connection of the ball type reciprocation operated tubing isolation valve 10 to a fracturing tool or other well service tool. The lower housing mandrel is of tubular configuration and establishes a flow passage 250 through which treatment fluid and formation fluid may flow, depending on the position of the valve ball member 128.

The drag block member 238 is radially expandable and collapsible and is composed of a plurality of elongate outwardly bowed spring ribs 246 that are integral with the annular guide ring 236 and with the lower end section 240. Each of the spring ribs 246 is provided with a central drag element 248 that is urged by the spring-like nature of the spring ribs 246 into friction engagement with the inner surface of the tubular element, i.e., well tubing or well casing, within which it is conveyed. The central drag elements 248 may also enter and establish retention within casing collars and other anomalies within the casing. This frictional and/or retention relationship causes application of a force to the tubing isolation valve mechanism for controlling actuation of the indexing mechanism and, depending on the condition of the indexing mechanism, for actuating the valve mechanism between its open and closed conditions responsive to the reciprocation movement of the tubing string.

The support and guide tube 242 defines an internal receptacle 252 which defines an elongate internal cylindrical guide surface 254 that is engaged by an annular piston seal assembly 256 of a piston enlargement 258 that is provided at the lower end of the support and guide tube 218. An anti-rotation key 262, mounted to the lower housing mandrel 242, engages within a linear slot 264 of the support and guide tube 218 and ensures that rotational indexing movement of the indexing sleeve due to the frictional resistance of the annular seal assemblies does not cause rotational movement of the support and guide tube 218.

Operation of Reciprocation Actuated Tubing Isolation Valve

The reciprocation operated isolation valve mechanism 110 is controlled by a four-position indexing slot 210 of the indexing sleeve 164, also referred to as a J-slot, which is engaged by the guide element 200 and establishes four operating positions of the tubing isolation valve mechanism, though more indexing positions may be employed in the event additional activities or features or operations are needed. At Position 1, the tubing isolation valve mechanism is in the telescopically extended position shown in FIGS. 8A and 8B and the valve ball member 128 is open. At Position 1, with the tubing isolation valve open, treatment fluid can flow through the tubing string and through the open tubing isolation valve and through the fracturing or other well treatment tool to the reservoir intersected by the perforated zone of the casing. At Position 2, the tubing isolation valve mechanism is in the collapsed position as shown in FIGS. 9A–9D and the valve ball element 128 is closed. At this position the reservoir is isolated from the hydrostatic pressure of fluid within the tubing string and the tubing string is isolated from formation pressure. At Position 3, the tubing isolation valve mechanism is in the extended position shown in FIGS. 8A–8D and the valve ball element 128 is closed. At Position 4, the tubing isolation valve mechanism is again in the collapsed position shown in FIGS. 9A–9D and the valve ball element 128 is closed. It should be noted that a straddle packer well treatment tool, such as a formation fracturing tool, will be connected to the tubing isolation valve mechanism at the lower threaded connection 244. Drag from the cup packer elements 28 and 30 of the straddle packer formation treatment tool assembly 10 with the casing or an optional drag block assembly 238 provide resistance at the downhole end of the tubing isolation valve mechanism so that relative motion can be achieved between the upper and lower telescoping sections of the valve and valve actuator mechanism to actuate the indexing mechanism and to open and close the tubing isolation valve mechanism 110, (additional indexing positions could be used for other operations.)

FIG. 1, shows a treatment tool assembly in the run-in-hole position. FIGS. 8A–8D show the reciprocation operated tubing isolation valve mechanism in the open position, Position 1. It should be noted that a ball valve is illustrated to provide the function of an isolation valve but it should be borne in mind that a sleeve valve may also be used to provide for reservoir isolation without departing from the spirit and scope of the present invention. The coiled tubing string is typically filled with fluid prior to running into the well. As the tool enters the casing the tool shifts closed to Position 2.

Just prior to reaching the perforated intervals the downhole tool system is tested. The straddle tool is placed in a non-perforated section of casing and the isolation valve is cycled to Position 1 by reciprocating the tubing string. With the isolation valve open the dump valve is closed by pumping down the coiled tubing at a predetermined rate. When the dump valve closes, fluid is forced into the area isolated by the straddle packer, resulting in a rapid rise in pressure, at which point the pumps are stopped. The pressure is bled off of the coiled tubing at the surface and the dump valve opens. The tool is then moved to the first perforated interval. The first movement down closes the tubing isolation valve.

With the straddle tool assembly located at the zone of interest, the isolation valve is cycled open to Position 1. The flow responsive dump valve is closed by pumping down the coiled tubing. When the dump valve closes, fluid is forced into the formation isolated by the straddle packer elements of the formation treatment tool. The fluid flow and pressure are then increased until the selected formation zone fractures and slurry is pumped into the fractures of the formation as shown schematically in FIG. 2.

After the selected formation zone has been fractured, some formation treatment slurry remains in the coiled tubing and in the packer isolated annular area between the casing and the straddle tool. Tubing pressure is then bled off at the surface. As the tubing pressure lowers, the dump valve spring overcomes the force created by the differential pressure across the dump valve seat and the dump valve element will be moved to its open position by its valve spring. With the dump valve open, clean fluid is pumped down the coiled tubing string 16, through the straddle packer formation treatment tool and out the open dump valve into the wellbore below the straddle packer as shown schematically in FIG. 3. After slurry clean-out has been completed, pumping of clean fluid is stopped, allowing pressure equalization to occur via the open dump valve and open tubing isolation valve. With the pressures equalized across the cup packer elements 28 and 30 and inside the coiled tubing 16 and the casing annulus the packer elements will relax within the well casing, permitting the tool to then be moved to the next zone and the process repeated. If the formation zones are treated from the bottom up, the tubing isolation valve will remain open.

FIG. 1, shows a treatment tool assembly during the run-in-hole position. FIGS. 8A–8D show the reciprocation operated isolation valve in the open position. In an overpressured well, the coiled tubing would be filled with fluid before it is connected to the wellhead. When the wellhead is opened the tool and the coiled tubing will be pressured to the wellhead surface pressure. As the isolation valve enters the casing the valve ball member is rotated closed, as shown in FIGS. 9A–9B. With the tubing isolation valve closed, pressure can be bled off of the coiled tubing and the coiled tubing can now be run-in-hole with a controlled differential. Optionally, the tubing isolation valve could be assembled in the closed position after the coiled tubing has been filled with fluid.

To pressure test the tool string, stop running in hole prior to reaching the perforated intervals. Apply pressure to the coiled tubing so that the pressure differential across the ball valve is small. Cycle the isolation valve to Position 1 to open the valve. (Note this cycling of the pipe does not cause significant damage to the tubing since the tubing movement is small enough that tubing is not bent over the gooseneck or around the reel of the coiled tubing equipment located at the surface.) The flow responsive dump valve 24 is closed by pumping down the coiled tubing at a predetermined rate to cause closing movement of the dump valve element 48.

When the dump valve closes, fluid is forced into the area isolated by the straddle packer, resulting in a rapid rise in pressure, at which point the pumps are stopped. The pressure is bled off of the coiled tubing at the surface until the dump valve opens. The tubing isolation valve mechanism is then cycled to the closed position by lowering the tubing string and setting down weight. The pressure of the coiled tubing is then bled off to cause balancing of pressure across the spaced straddle packer elements, thus relaxing the straddle packer elements from the well casing to permit conveyance of the coiled tubing and the formation treatment tool to the first perforated interval.

With the straddle tool assembly located at the zone of interest, pressure is applied in controlled manner to the coiled tubing so that the pressure differential across the ball valve is small. The coiled tubing is then cycled by upward and/or downward movement to cause the indexing mechanism thereof to open the tubing isolation valve. Fluid is then pumped down the coiled tubing at sufficient velocity to close the dump valve. When the dump valve closes, formation treatment fluid is forced through the casing perforations and into the formation isolated by the straddle packer elements. The fluid flow and pressure are increased until the selected formation zone fractures and formation treatment slurry is pumped into the formation as shown in FIG. 2.

After the formation zone has been fractured and has accepted formation treatment slurry into the fractures, pumping of formation treatment fluid is stopped. At this point, some slurry normally remains in the coiled tubing and in the annular area between the casing and the straddle tool. The isolation valve is then closed by moving the coiled tubing down to Position 2. In some formations the pressure of the fractured interval will return to the prefrac pressure rapidly. When this occurs the pressure differential across the dump valve seat is reduced until the dump valve opens. In tight formations this pressure equalization may not occur rapidly. In this case pressure can be applied at the surface to the casing/coiled tubing annulus until the differential pressure across the dump valve seat is low enough to open the valve.

With the dump valve open, the coiled tubing is cycled again to open the ball valve. Clean fluid is pumped down the coiled tubing, through the straddle tool and out the dump valve into the wellbore below the straddle packer as shown in FIG. 3. At this point the coiled tubing is cycled to Position 3 to close the tubing isolation valve and pressure is bled off at the surface. The coiled tubing pressure is reduced to the desired pressure while the reservoir pressure is isolated from the coiled tubing. The straddle packer formation treatment tool assembly can now be moved up-hole to the next perforated interval. Since the pressure of the coiled tubing will have been significantly decreased, movement of the coiled tubing over the gooseneck and around the reel of the coiled tubing handling equipment at the surface will not significantly degrade the service life of the coiled tubing.

FIG. 1 shows a treatment tool assembly during the run-in-hole position. FIGS. 8A–8D show the reciprocation operated tubing isolation valve in the open position. In an underbalanced well, the coiled tubing would be filled with fluid before it is connected to the wellhead. When the wellhead is opened, the tool is run-in-hole. As the isolation valve mechanism 110 enters the casing 14 the valve ball 122 is rotated closed as shown in FIGS. 9A–9D. See above for a detailed description of the valve operation. With the tubing isolation valve closed, the hydrostatic pressure created by the column of fluid in the coiled tubing is isolated from the underbalanced formation. Optionally, the isolation valve could be assembled in the closed position after the coil is filled with fluid and before running the well service tool into the well.

To pressure test the tool string, tool running in hole is stopped prior to reaching the perforated intervals. The tubing isolation valve is then cycled to Position 1 to open the valve element 122 by upward and downward cycling movement of the tubing string against drag block or packer element resistance. The flow responsive dump valve 24 is then closed by pumping down the coiled tubing at a predetermined rate. When the dump valve closes, fluid is forced into the area isolated by the straddle packer elements 28 and 30, resulting in a rapid rise in pressure, at which point the pumps are stopped. The pressure is bled off of the coiled tubing 16 at the surface until the dump valve is opened by its valve return spring. The tubing isolation valve is then cycled to the closed position by lowering the tubing string and setting down weight. The formation treatment tool is then moved to the first perforated interval where formation fracturing or other formation treatment is then carried out. In extreme underbalanced cases, pressure testing should be omitted since the dump valve spring may not be strong enough to open the dump valve against the pressure induced force that is developed by a full hydrostatic column of fluid in the tubing string.

With the straddle tool assembly located at the zone of interest, the coiled tubing is then cycled to cause the indexing mechanism to open the valve. Fluid is then pumped down the coiled tubing to close the dump valve 24. When the dump valve closes, fluid is forced into the formation isolated by the straddle packer. The fluid flow and pressure are increased until the selected zone fractures and slurry is pumped into the formation as shown schematically in FIG. 2.

After the zone has been fractured, some slurry normally remains in the coiled tubing and in the annular area between the casing and the straddle tool. The isolation valve is closed by moving the coiled tubing down to position 2. The pressure of the underbalanced formation will return to the prefrac pressure rapidly. When this occurs the pressure differential across the dump valve seat is reduced until the dump valve opens.

With the dump valve open, the coiled tubing is cycled again to cause the indexing mechanism to open the ball valve. Clean fluid is pumped down the coiled tubing, through the straddle tool and out the dump valve into the wellbore below the straddle packer as shown in FIG. 3. At this point the coiled tubing is cycled to Position 3 to close the tubing isolation valve, isolating the formation from the hydrostatic pressure of the coiled tubing. The straddle packer formation treatment tool assembly can now be moved up hole to the next perforated interval.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6, for any limitations of any of the claims herein, except for those in which the claim expressly uses the words "means for" together with an associated function.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A method for formation treatment, comprising:

running into a well casing on a tubing string a formation treatment tool having spaced straddle packer elements establishing an isolated casing zone within the well casing and having fluid supply passage and an injection port directing fluid flow from the fluid supply flow passage into the isolated casing annulus zone and an inlet port and fluid discharge flow passage receiving well treatment fluid from the isolated casing zone, the formation treatment tool having a dump valve controlling discharge of fluid from said discharge flow passage into the well casing and further having a tubing isolation valve controlling fluid communication between the tubing string and formation treatment tool;

locating the formation treatment tool with said straddle packer elements positioned respectively above and below casing perforations of a selected casing interval;

with said dump valve closed and said tubing isolation valve open, causing formation treatment by causing treatment fluid flow through said tubing string, tubing isolation valve, fluid supply passage and injection port into the isolated casing zone and through the casing perforations into the surrounding formation;

after formation treatment opening the dump valve and discharging excess formation treatment fluid from the tubing string, fluid supply passage and isolated casing zone into the well casing below the formation treatment tool;

closing the tubing isolation valve;

equalizing fluid pressure across said straddle packer elements; and with the tubing string, conveying the formation treatment tool within the well casing.

2. The method of claim 1, wherein said tubing isolation valve is flow responsive for opening and closing operation, said method comprising:

running said well service tool into the well casing with said tubing isolation valve open permitting fluid flow through said tubing isolation valve during running;

with said spaced packer elements of said well service tool positioned to straddle a perforated casing zone, causing formation treatment fluid to flow through said tubing string and tubing isolation valve into the isolated casing zone; and after completion of formation treatment causing flow responsive closure of said tubing isolation valve by flow of formation fluid and isolating the tubing string from formation pressure.

3. The method of claim 2, comprising:

prior to formation treatment positioning said formation treatment tool in a non-perforated zone of the well casing;

conducting a formation treatment tool pressure test by injecting fluid pressure into the well casing between said straddle packer elements and causing flow responsive closing of said dump valve;

after pressure testing confirmation of said formation treatment tool, bleeding fluid pressure from between said spaced straddle packer elements via the tubing string and freeing said formation treatment tool for conveyance within the well casing;

conveying said formation treatment tool to a desired perforated casing zone; and conducting said formation treatment operation.

4. The method of claim 1, wherein said tubing isolation valve is operated to open and closed positions by causing linear cycling movement of said tubing string for selective opening and closing operation, said method comprising:

cycling said tubing isolation valve to said open position;

running said well service tool into the well casing with said tubing isolation valve at said open position;

selectively positioning said formation treatment tool within the well casing after completion of formation treatment, cycling said tubing isolation valve to said closed position isolating the formation from hydrostatic tubing pressure in the event of underbalanced wells.

5. The method of claim 4, said tubing isolation valve having an indexing housing and an indexing sleeve being linearly moveable within the indexing housing and being moveable responsive to linear cycling movement of said tubing string and defining an indexing recess and an indexing element being mounted to said valve housing and having indexing engagement within said indexing recess, a valve element being actuated to open and closed positions upon selective linear movement of said indexing sleeve, said method comprising:

actuating said spaced packer elements to sealing engagement within the well casing; and actuating said valve element to desired position by linear cycling movement of said indexing sleeve by the tubing string.

6. The method of claim 5, comprising:

positioning said formation treatment tool in an non-perforated zone of the well casing;

pressure testing said formation treatment tool and closing said dump valve by application of fluid pressure via the tubing string treatment fluid supply passage and injection port into the well casing between said spaced packer elements;

after pressure testing bleeding fluid pressure from the tubing string causing opening of said dump valve;

conveying said formation treatment tool to a selected perforated zone of the well casing;

moving said valve element to its open position by controlled cycling the tubing string; and treating the formation surrounding the perforated zone of the well casing.

7. The method of claim 1, wherein said tubing isolation valve is operated to open and closed positions by causing linear cycling movement of said tubing string for selective opening and closing operation, said method comprising:

cycling said tubing isolation valve to said closed position;

running said well service tool into the well casing with said tubing isolation valve at said closed position;

selectively positioning said formation treatment tool within the well casing;

cycling said tubing isolation valve to said open position;

treating the formation;

after completion of formation treatment, cycling said tubing isolation valve to said closed position isolating the tubing string from formation pressure in the event of overpressured wells and isolating the formation from hydrostatic tubing pressure in the event of underbalanced wells.

8. The method of claim 7, said tubing isolation valve having an indexing housing and an indexing sleeve being linearly moveable within the indexing housing and being moveable responsive to linear cycling movement of said tubing string and defining an indexing recess and an indexing element being mounted to said valve housing and having indexing engagement within said indexing recess, a valve element being actuated to open and closed positions upon selective linear movement of said indexing sleeve, said method further comprising:

actuating said valve element to desired position by linear cycling movement of said indexing sleeve by the tubing string.

9. The method of claim 8, comprising:

positioning said formation treatment tool in an non-perforated zone of the well casing;

pressure testing said formation treatment tool and closing said dump valve by application of fluid pressure via the tubing string treatment fluid supply passage and injection port into the well casing between said spaced packer elements;

after pressure testing bleeding fluid pressure from the tubing string causing opening of said dump valve;

conveying said formation treatment tool to a selected perforated zone of the well casing;

moving said valve element to its open position by controlled cycling the tubing string; and treating the formation surrounding the perforated zone of the well casing.

10. The method of claim 1, comprising:

conveying said formation treatment tool within the well casing by surface equipment movement of the tubing string when the tubing string is substantially free of formation pressure.

11. A formation treatment assembly for treating a subsurface formation being intersected by a well casing, the well casing being perforated at one or more casing zones, comprising:

a pair of spaced straddle packer elements being activated to establish sealing engagement with the well casing and defining an isolated casing zone therebetween and being deactivated to release sealing engagement with the well casing;

a formation treatment tool being conveyed within a well casing by a tubing string and defining a treatment fluid supply passage and a treatment fluid discharge passage and having a fluid injection port through which treatment fluid is ejected from the treatment fluid supply passage into the isolated casing zone and a fluid inlet port permitting flow from the isolated casing zone to said treatment fluid discharge passage;

a dump valve being in fluid communication with said formation treatment tool and being open to permit flow of treatment fluid from the isolated casing zone through said treatment fluid discharge passage and closed to prevent flow of formation treatment fluid from the isolated casing zone; and a tubing isolation valve being in communication with said formation treatment tool and having a valve element being moveable to an open position to permit treatment fluid flow through said treatment fluid supply passage into the isolated casing zone and being closed to isolate the tubing string from pressure within said treatment fluid supply passage.

12. The formation treatment assembly of claim 11, comprising:

said spaced packer elements being supported by said formation treatment tool; and said fluid injection port and said fluid inlet port being located between said spaced packer elements.

13. The formation treatment assembly of claim 11, comprising:

said tubing isolation valve being hydraulically actuated to said open and closed positions responsive to fluid flow.

14. The formation treatment assembly of claim 13, comprising:

said tubing isolation valve having a valve housing having a flow passage in communication with the tubing string and having a valve seat;

a linearly moveable valve element being moveable within said valve housing responsive to upward and downward fluid flow and being disposed for sealing engagement with said valve seat at a closed position isolating the tubing string from formation pressure in the event of an overpressured reservoir condition, said linearly moveable valve element being open during downward fluid flow of formation treatment and being closed by predetermined velocity of upward fluid flow.

15. The formation treatment assembly of claim 11, comprising:

said tubing isolation valve having a valve housing having a flow passage in communication with the tubing string and having a valve seat;

a linearly moveable poppet valve element being supported for linear movement within said valve housing and having a valve head disposed for sealing engagement with said valve seat; and at least one spring normally positioning said linearly moveable poppet valve element at an open position with said valve head spaced from said valve seat and permitting fluid flow through said tubing isolation valve during conveyance of said formation treatment tool assembly within the well casing.

16. The formation treatment assembly of claim 15, comprising:

said at least one spring being a primary spring urging said linearly moveable poppet valve element toward said closed position and a secondary spring urging said linearly moveable poppet valve element toward said open position, in absence of fluid flow said primary and secondary springs maintaining said linearly moveable poppet valve element at a partially open position; and fluid flow during formation treatment moving said linearly moveable poppet valve element from said partially open position to a full open position and formation fluid flow moving said linearly moveable poppet valve element to said closed position isolating the tubing string from formation pressure.

17. The formation treatment assembly of claim 11, comprising:

said tubing isolation valve being mechanically actuated to said open and closed positions responsive to selective upward and downward cycling of the tubing string.

18. The formation treatment assembly of claim 17, comprising:

said tubing isolation valve having an indexing housing;

an indexing sleeve being linearly moveable within the indexing housing and being moveable responsive to linear cycling movement of the tubing string;

said indexing sleeve defining an indexing recess having a plurality of indexing positions;

an indexing guide element being mounted to said indexing housing and having indexing engagement within said indexing recess; and a valve element being actuated to open and closed positions upon selective linear movement of said indexing sleeve relative to said indexing housing.

19. The formation treatment assembly of claim 18, comprising:

said tubing isolation valve being a ball valve mechanism having a valve housing;

a valve ball element being rotatable within said valve housing between open and closed positions; and said indexing sleeve having actuating relation with said valve ball and selectively moving said valve ball to said open and closed positions responsive to linear cycling movement of said indexing sleeve by the tubing string.

20. The formation treatment assembly of claim 18, comprising:

a drag member being connected with said indexing sleeve and having resistance engagement within the well casing, said drag member transmitting force to said indexing sleeve during conveyance of said formation treatment assembly through the well casing and causing selective operation of said indexing sleeve and selective operation of said valve ball element to said open and closed positions.

21. The formation treatment assembly of claim 20, comprising:

a support tube being connected with said indexing housing;

said drag member being mounted for linear movement on said support tube and responsive to conveyance of said formation treatment assembly within the well casing imparting telescoping force to said indexing housing causing indexing movement of said indexing housing relative to said indexing sleeve and selectively moving said indexing sleeve to positions controlling movement of said valve ball element to said open and closed positions thereof.

* * * * *